United States Patent [19]

Uno et al.

[11] 4,449,022

[45] May 15, 1984

[54] SELF-HOLDING TYPE PUSH SWITCH WITH HEART TYPE CAM

[75] Inventors: Hiroshi Uno, Yao; Kenji Furuhashi, Osaka, both of Japan

[73] Assignee: Hosiden Electronics, Co., Ltd., Yao, Japan

[21] Appl. No.: 463,490

[22] Filed: Feb. 3, 1983

[30] Foreign Application Priority Data

Feb. 12, 1982 [JP] Japan ..... 57-19054[U]

[51] Int. Cl.[3] ..... H01H 13/56

[52] U.S. Cl. ..... 200/153 J; 200/328

[58] Field of Search ..... 200/153 J, 328

[56] References Cited

U.S. PATENT DOCUMENTS 4,112,277 9/1978 Kleeb ..... 200/328 X 4,382,167 5/1983 Maruyama et al. ..... 200/153 J 4,383,153 5/1983 Kondo et al. ..... 200/153 J

FOREIGN PATENT DOCUMENTS 1285260 1/1962 France ..... 200/153 J

*Primary Examiner*—John W. Shepperd

*Assistant Examiner*—Renee S. Kidorf

*Attorney, Agent, or Firm*—Steele, Gould & Fried

[57] ABSTRACT

A self-holding type push switch is capable of switching over contacts by alternatively holding and releasing a slider having a heart type cam, using an engaging mechanism received in receptacle grooves of a switch case. The engaging mechanism comprises a hook rod adapted to move into and out of engagement in a recess of the heart-shaped cam and a spring plate member for movably holding the rod between portions resiliently urged together over the rod.

6 Claims, 4 Drawing Figures

SELF-HOLDING TYPE PUSH SWITCH WITH HEART TYPE CAM

BACKGROUND OF THE INVENTION

1. Field of the Invention

This invention relates to a self-holding type push switch with heart-shaped cam, which permits easy assembly by first forming a spring member positively engaging a hook rod.

2. Prior Art

It is widely known that a push switch having a slider means slidably received in a switch case can be provided with a so-called heart type cam. The cam is located on the slider means and is heart-shaped in section in such a manner that a hook rod pivotably supported on the switch case and bent at the end in a hook shape is adapted to trace the outer circumference of the cam. The end of the hook rod travels around the outer circumference of the cam as the slider means moves, to bring the rod into and out of engagement with the recess of the heart-shaped cam, and positions the slider means at a predetermined position along its sliding direction.

In order to make it possible for the hook rod to exactly travel around the cam, it is necessary to constantly urge a spring member, for example, a plate spring, against the slider means. However, because the hook rod and the spring member were conventionally provided in the form of separate parts easily disengaged and free to move with respect to each other, it was a general practice in assembling to bring one end of the hook rod into engagement with an engagement hole formed in the switch case by use of pincers, insert a plate spring having an end bent in an L-shape into the switch case through a slit in the bottom of the switch case, bring the spring into contact with the hook rod and then fix the end of the spring, for example, by an adhesive, to the outside bottom of the switch case.

Accordingly, mounting the hook rod and the spring member, and assembly of the switch, was troublesome work. Assembly was difficult and required use of assembling tools such as pincers, with the result that the assembly was not very workable, and the number of assembling steps and working time was increased.

In addition, since the hook rod and spring member were handled as parts independent from each other, the added number of parts and the control of parts was also troublesome.

SUMMARY OF THE INVENTION

Accordingly, a primary object of the invention is to provide a self-holding type push switch having an effectively reduced number of parts, handling a hook rod and a spring plate member as a one-piece part, by positively engaging the hook rod with the spring plate member.

Another object of the invention is to improve the ease of assembly of the switch, which has heretofore been carried out by use of assembling tools such as pincers, due to receiving an engaging means made up of a hook and spring member into a switch case by simply inserting a spring member into receptacle grooves in the switch case.

Yet another object of the invention is to decrease the number of loose parts of the switch to thereby facilitate control of the parts requirements and reduce the number of assembling steps.

A further object is to shorten working time necessary for assembly of the switch by handling the slider-engaging means as a one-piece part made up of a spring plate member and captive hook rod.

These and other objects have been attained by the push switch which comprises a switch case, an engaging means, and slider means wherein the engaging means is made up of a hook and a spring plate member and the spring plate positively engages the hook.

BRIEF DESCRIPTION OF THE DRAWINGS

Other features and advantages of the invention will become apparent from the following description of a preferred embodiment of the invention described in conjunction with the accompanying drawings wherein.

DETAILED DESCRIPTION OF THE PREFERRED EMBODIMENT

Figure 1:
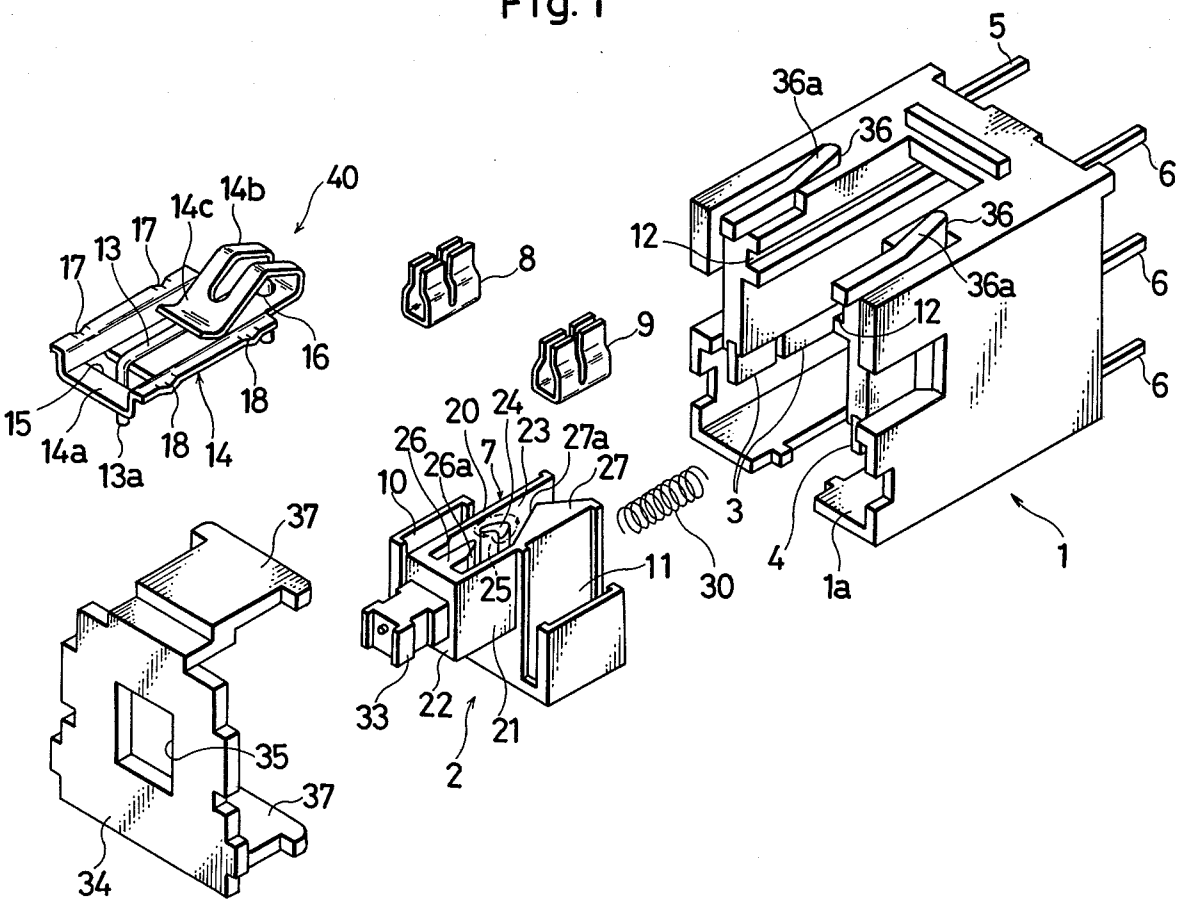
FIG. 1 is an exploded view in perspective of a preferred embodiment of the invention.

Referring now to a preferred embodiment of the invention in conjunction with the drawings, the numeral 1 designates a box-shape switch case of resin, having an opening portion 1*a*. The switch case slidably receives a slider means 2 inserted from the side 1*a*. One or more series of contact pieces 3 and 4 constitute switching units and are made up respectively of sets of three contact pieces disposed on both inner sides of the opening portion 1*a* of the case 1 in a longitudinal line along the sliding direction of the slider means 2.

The contact pieces 3 and 4 are provided integrally with terminal portions 5 and 6 projecting from the bottom of the case 1. The contact pieces are made integral with the case 1 by insert molding when the casing 1 is molded.

The slider means 2 is centrally formed with a tracing portion 7 (to be described later), and on opposite sides of the portion 7 are formed clip holders 10, 11 for receiving clips 8, 9, shaped by bending a thin metal sheet. The clips 8, 9 are received inside the clip holders 10 and 11 and are adapted to clamp portions of the contact pieces 3, 4 when the slider means 2 is placed in the switch case 1. The clips electrically connect portions of the contact pieces 3, 4, upon slide movement of the slider 2. In short, out of each set of contact pieces 3 and 4, the contact piece in the middle, and either set of two on the right and left sides, are selectively bridged by the clips 8 and 9. The clips and contact pieces are designed to change the position of the bridging portion of the clips 8 and 9 with respect to the contact pieces 3 and 4 upon sliding the slider means 2.

An engaging means 40 comprises a hook rod 13 and a spring member 14. The engaging means is installed by pressing the spring member into the facing receptacle grooves 12 and 12 of the switch case 1. The spring member 14 positively holds the hook rod 13 captive, the hook rod being bent at both ends in a C-shape.

The spring member 14 is provided at the opposite ends of a main plate body 14*a* with a slit 15 and a pivot hole 16, into which the respective ends of the hook rod 13 are inserted. One end of the hook rod 13 is positioned by the pivot hole 16 such that the hook rod 13 is pivotably supported by the spring member 14 throughout the range in which the end portion 13*a* of the rod 13 may move within the slit 13 while pivoting in hole 16.

The intermediate portion of the hook rod 13 is resiliently pressed against the spring plate by the end portion 14*c* of a bent over piece 14*b* obtained by bending over one end of the spring member 14. Both side portions of the main portion 14*a* of the spring member 14 are also bent to form flanges along the overall length thereof. The edge portions of the main portion 14*a* are provided with respective pairs of recesses 17, 17 and 18, 18, so that the spring member 14 is secure when pressed into the receptacle grooves 12 and 12.

The end portion 13*a* of the hook rod 13 is inserted into a tracing portion 7 formed on the side of slider means 2 directed toward the spring member 14, both being received into the switch case 1.

The tracing portion 7 includes a heart type cam 24, heart-shaped in section, and a projecting guide wall 26. The cam 24 protrudes approximately centrally in a space 23 defined by a pair of partition walls 20 and 21. The walls 20, 21 are placed in opposed relationship with each other, and a top wall 22 connects the wall 20 to the wall 21. The end portion of the guide wall 26 is wedge-shaped in section and has a tapered portion 26*a* on one side thereof. The end portion is disposed in opposed relation with the heart type cam 24.

The partition wall 21 is widened inside to form a projecting guide portion 27, triangular in section, having a tapered portion 27*a*. Accordingly, the front end portion 13*a* of the hook rod 13, when inserted into the tracing portion 7, is guided by the partition walls 20, 21, a projecting guide wall 26 and a guide projection 27, during stages of the reciprocating movement of the slider means 2, and travels around the outer circumference of the cam 24 as shown by a dotted line in FIG. 1. Therefore, the end portion 13*a* of the hook rod 13 is alternately changed over between a first state in which the end portion 13*a* is engaged in the recess 25 of the cam 24 and a second state in which the portion 13*a* of the hook rod 13 is disengaged from the recess 25 of the cam 24. Thus, the end 13*a* of the hook rod 13 is positioned based upon the direction in which the slider means 2 slides.

A coil spring 30 is adapted to resiliently urge the slider means 2 outwardly. One end of the spring is inserted into a boss 31 formed in the bottom of the switch case 1 and is thereby supported on the switch case 1, while the other end of the spring is received into the receptacle portion 32 formed on the bottom of the slider means 2.

The top wall 22 is provided at the top with a protruding operation part 33, which is depressed to reciprocate the slider means 2. The operation part 33 is designed to have a control button (not shown) fitted thereover.

The numeral 34 designates a cover for closing the opening portion 1*a* of the switch case 1, and the cover 34 has a central insertion hole 35 for receiving the operation part 33. Claw portions 37, 37 protrude on either side of cover 34, and are designed for engagement with locking projections 36, having tapered portions 36*a* which extend from the outer wall of the switch case 1, and over which claws 37 lock.

Figure 2A:
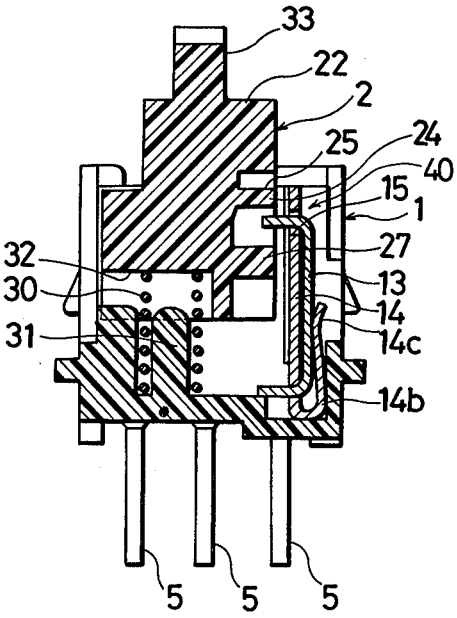
FIGS. 2*a* and 2*b* are sectional elevation views showing the respective states of switching over the contact pieces of the push switch shown in the embodiment of FIG. 1; and, FIG. 3 is a longitudinal section view of an engaging means showing the engagement of the hook rod by the spring member.
Figure 2B:
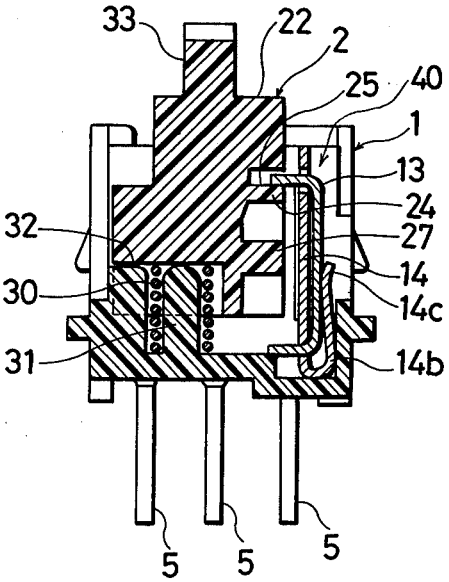
Figure 3:
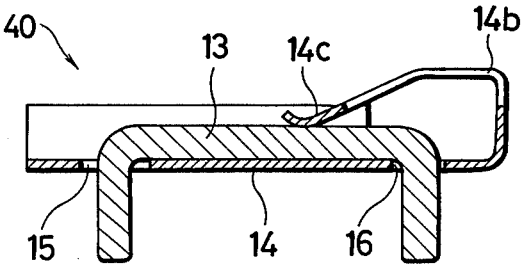

According to the structure described above, when the slider 2 is moved inwardly by depressing the operation part 33 in the state shown in FIG. 2*a*, the front end 13*a* of the hook rod 13 travels around the outer circumference of the heart type cam 24 and comes into engagement in the recess 25 of the cam 24, with the result that the relative positions of the slider means 2 and the case 1 in FIG. 2*a* are switched over to the state shown in FIG. 2*b*.

Upon again depressing operation part 33 and slider 2, the end portion 13*a* of the hook rod 13 is moved away from the recess 25 of the cam 24 and the cam is disengaged. The slider means 2 is urged outwardly by the spring 30 and the switch is changed over to the state shown in FIG. 2*a*. It will be understood that clips 8 and 9, housed in clip holders 10, 11, slide along with the movement of the slider 2 and the bridged relation of the clips with respect to the contact pieces 3 and 4 is switched over between the two states.

In the invention, the hook rod which traces the heart type cam 24 is shaped in a C-shape and the respective ends of the hook rod 13 are inserted through a pivot hold 16 and a slit formed in the spring member 14. The rod 13 is supported by the spring member 14, and since the intermediate portion of the hook rod remains pressed between member 14 and end portion 14*c* thereof, it is possible to attach the hook rod 13 and spring member 14 to form a one-piece body and to thereafter handle the rod 13 and the member 14 as a one-piece part.

Accordingly, when the spring member 14 and the hook rod 13 are installed in the switch case 1, all that is necessary is to press the member 14 into the receptacle grooves 12, 12 formed in the inner faces of switch case 1. In this manner, assembling is so simple that there is no need for any cumbersome operation by which such switches have heretofore been assembled, or use of assembling tools such as pincers. Assembly is therefore facilitated.

Since the hook rod 13 and the spring member 14 can be handled as a one-piece part, the number of parts to be handled can be decreased, the requirements for storage and issue of parts can be eased and in addition, the number of steps in assembling is decreased to shorten the work time necessary for assembling.

In addition thereto, since the intermediate portion of the hook rod 13 is designed to be at all times pressed by the front end portion 14*c* of the bent-up piece 14*b*, obtained by bending one end portion of the spring member 14, the operations of forming the spring member 14 with attached hook rod 13 and also applying a specified push pressure to the hook rod 13, can simultaneously be carried out. In short, fixing the hook rod 13 to the spring member 14 by bending one end of the spring member and setting the push pressure to the hook rod 13 by the bent-up piece 14*b* of the spring member 14 can be carried out by a one stroke operation.

Since the hook rod 13 is in fixed engagement with the spring member 14 by the push pressure from the bent-up piece 14*b* acting on the intermediate portion of the hook rod 13, there is no possibility of the hook rod 13 slipping out from the spring member 14, with the result that handling of the hook rod as a one-piece part is also facilitated.

In the embodiment illustrated, since the bent-up piece 14*b* is designed to be brought into contact with the inner wall portion of the switch case 1 in the condition that spring member 14 is already held in the switch case, and member 14 need not be deformed, it is possible to better maintain the elasticity of the bent-up piece 14*b* which presses the hook rod 13 to the slider means 2.

What is claimed is:

1. A self-holding type push switch with heart shaped cam, comprising:

a switch case, a slider means movably disposed in the switch case, and an engaging means limiting relative movement of the switch case and the slider;

said switch case defining an enclosure and having contact pieces therein for receiving said slider means and having rceptacle grooves for receiving said engaging means, the engaging means operative to alternately hold said slider means in specified inner and outer positions within the switch case;

said engaging means comprising a hook rod bent at both ends thereof to form a C-shape, and a spring plate member adapted to support said hook rod, said spring plate member having a pivot hole for pivotally carrying one end of said hook rod, and a slit for movably carrying the other end of said hook rod, the spring plate having a body and a bent-over piece adapted to press and hold said hook rod between the bent-over piece and the body of the spring plate;

said slider means having a heart-shaped cam having a recess and conductive contact pieces, the slider being resiliently urged outwardly by a spring member in said switch case, said slider means being adapted to bring said hook rod into engagement with the recess of said cam when the slider means is once depressed, thereby holding the slider in position and, when again depressed, to disengage said hook rod from the recess of said cam, whereby said slider means effects changeover of connection between said contact pieces.

2. A self-holding type push switch according to claim 1, wherein said conductive contact pieces in said slider means are conductive clips.

3. A self-holding push switch, comprising:

a switch case having contacts therein;

a slider movable inwardly and outwardly of the switch case, the slider being resiliently urged outwardly of the switch case by a spring, the slider having a heart-shaped cam on a side thereof and the slider having means for connecting the contacts; and, an engaging means having a hook rod movably disposed therein, an end of the hook rod engaging the heart-shaped cam, the engaging means being mounted within the switch case, and the hook rod being movably captive between resiliently-biased portions of the engaging means.

4. The push switch of claim 3, wherein the engaging means comprises a spring plate having a hole in a body thereof for one end of the hook rod and a slot for the other end of the hook rod, an end of the spring plate being bent over against the hook rod to urge an intermediate portion of the hook rod against the body of the spring plate.

5. The push switch of claim 4, wherein the engaing means is disposed in slots in the switch case, the engaging means being formed by assembly of the hook rod and spring plate for installation in the switch case in one piece.

6. The switch of claim 5, further comprising a cover plate attachable to external walls of the switch case, the cover plate holding the slider in the switch case.

* * * * *